US006420832B2

(12) United States Patent
Rabine

(10) Patent No.: US 6,420,832 B2
(45) Date of Patent: Jul. 16, 2002

(54) SWITCHING CIRCUIT WITH OVERLOAD PROTECTION

(75) Inventor: Robert C. Rabine, Shelby Township, MI (US)

(73) Assignee: KDS Controls, Inc., Troy, MI (US)

( * ) Notice: Subject to any disclaimer, the term of this patent is extended or adjusted under 35 U.S.C. 154(b) by 0 days.

(21) Appl. No.: 09/843,555

(22) Filed: Apr. 26, 2001

Related U.S. Application Data

(63) Continuation of application No. 09/539,087, filed on Mar. 30, 2000.

(51) Int. Cl.[7] ..... G08B 21/00

(52) U.S. Cl. ..... 315/77; 315/82; 315/200 A; 307/10.8

(58) Field of Search ..... 315/77, 82, 80, 315/200 A, 200 R, 185 R, 224, 225, 209 R, 291, 307; 307/9.1, 10.1, 10.8

(56) References Cited

U.S. PATENT DOCUMENTS 4,259,659 A * 3/1981 Ariyoshi et al. ..... 315/200 A
5,998,929 A * 12/1999 Bechtel et al. ..... 315/82
6,177,865 B1 * 1/2001 Bryant et al. ..... 315/77

* cited by examiner

*Primary Examiner*—Don Wong
*Assistant Examiner*—Wilson Lee
(74) *Attorney, Agent, or Firm*—Reising, Ethington, Barnes, Kisselle, Learman & McCulloch, P.C.

(57) ABSTRACT

A flasher circuit for switching incandescent lamps with field effect transistor switches is described for use on a school bus. A current sensing resistor develops an actual load current signal and a current limiting circuit which generates a signal corresponding to a predetermined limit value of load current. A control circuit turns off the field effect transistor when the actual value of load current exceeds the predetermined value. A micro controller holds the reference voltage at a higher level during the inrush current interval and switches it to a lower level during the steady state current.

12 Claims, 6 Drawing Sheets

SWITCHING CIRCUIT WITH OVERLOAD PROTECTION

This application is a continuation of Ser. No. 09/539,087 filed Mar. 30, 2000.

FIELD OF THE INVENTION

This invention relates to semi-conductor switching circuits; more particularly, it relates to overload protection especially adapted for field effect transistor switching circuits such as those used as flashers for warning lamps on school busses.

BACKGROUND OF THE INVENTION

It is common practice to provide school busses with warning lamp flashers such as amber caution lamps and red stop lamps. In such systems, the lamps which are flashed are typically incandescent lamps and, to produce the flashing effect, each lamp is turned on and off repetitively with a typical cycle of 400 milliseconds (ms) on-time and 400 ms off-time. Typically, a pair of amber lamps and a pair of red lamps are located on the front of the bus with one lamp of each color on the left side and one lamp of each color on the right side. A similar set of lamps is located at the rear of the bus.

It is well known that incandescent lamps exhibit a relatively low initial value of electrical resistance upon turn-on of the lamp and the resistance increases as the lamp filament temperature increases thus resulting in a high level inrush current which, after a short interval, subsides to a steady state value.

It is well known that power field effect transistors (FETs) are operable as power switching devices with very high power efficiency. However, the use of a FET for switching an incandescent lamp repetitively on and off requires special overcurrent protection for the FET due to the inrush current effect, short circuit or other transients. Operation of a FET at excessive or overcurrent values results in damage or destruction of the FET. Also, the use of a FET in a school bus flasher circuit module imposes a problem of damage or destruction of the FET resulting from a floating ground condition which may occur in the installation of the flasher module in the vehicle.

There is a need for a school bus flasher module which utilizes FETs for switching the lamp current and which provides protection of the FETs against operation at damaging current levels. Such a device must be of small size, reliable in operation and economical to manufacture.

A general object of this invention is to provide an improved flasher module, especially adapted for school busses, with FET switching devices which are protected against damaging current levels. Further, it is an object of the invention to provide a FET switching circuit useful in other applications with protection against damaging overcurrents.

SUMMARY OF THE INVENTION

In accordance with this invention, a school bus flasher circuit is provided in which a lamp load current is switched by a FET. A current sensing means generates a first signal voltage corresponding to actual lamp current and a load current limiting circuit generates a second signal voltage corresponding to a preset limit value of lamp current. A micro controller is responsive to the signal voltages and operates to disconnect the switching voltage from the gate of the FET when the first signal voltage exceeds the second signal voltage. The micro controller operates to change the reference voltage between a higher level during the lamp inrush current interval to a lower level during the steady state lamp current interval.

BEST MODE FOR CARRYING OUT THE INVENTION

Figure 1:
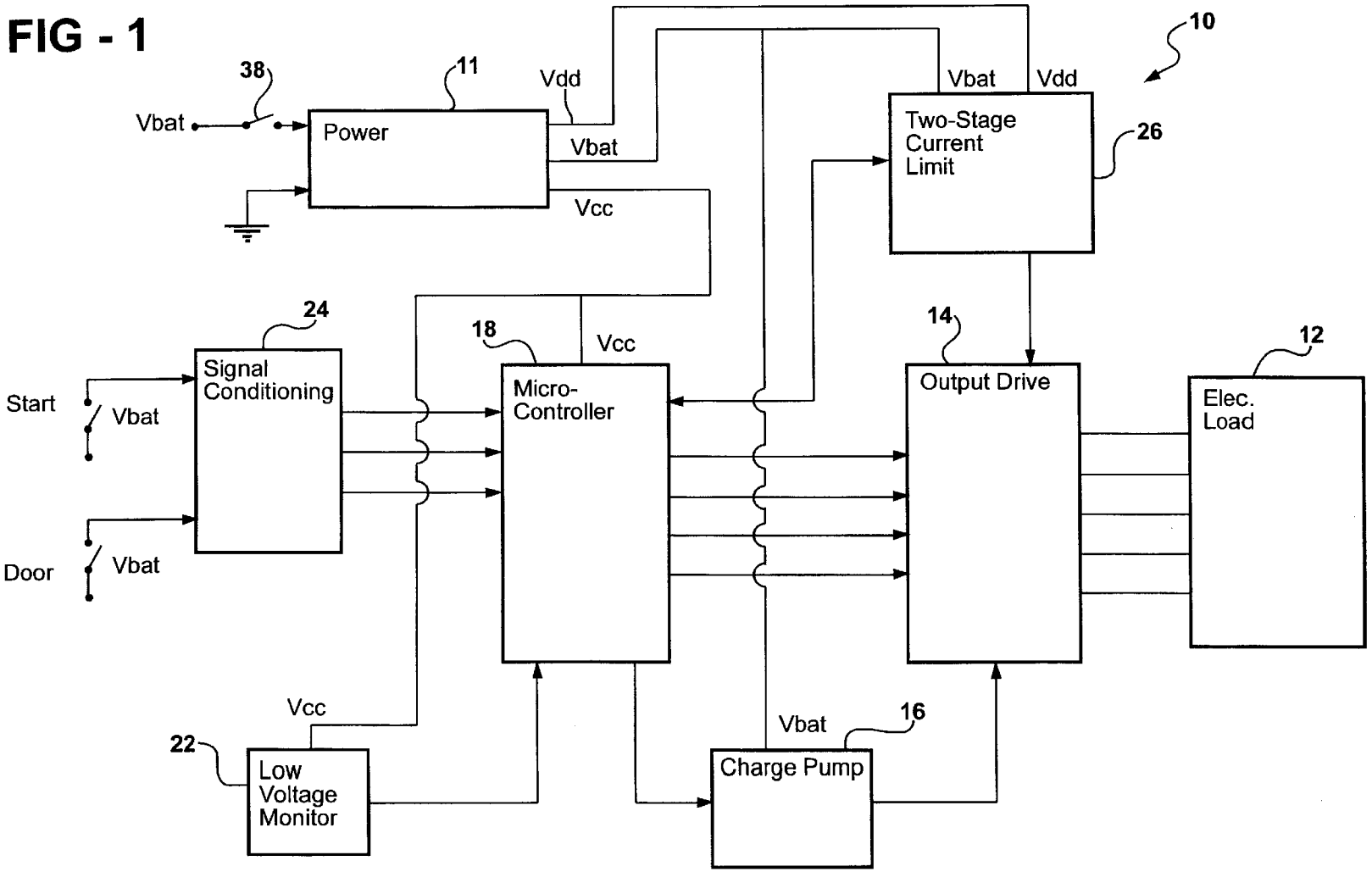
FIG. 1 is a block diagram of a lamp flasher circuit incorporating the subject invention.

Referring now to the drawings, there is shown an illustrative embodiment of the invention in a flasher circuit especially adapted for school busses. In this embodiment, field effect transistors (FETs) are used for switching the currents of the signal lamps and other safety devices on the school bus. According to the invention, the FETs are protected against over current which occurs as in-rush current, other transient currents or short circuit currents. It will be appreciated as the description proceeds that the invention may be realized in a wide variety of embodiments and is useful in many different applications.

The block diagram of FIG. 1 represents an illustrative embodiment of a school bus flasher circuit 10 for energizing an electrical load 12 which may include plural pairs of warning lamps and one or more pivotable stop signs. A power supply 11 supplies the various voltage level requirements to the other sections of the flasher circuit and is supplied with DC power from the vehicle battery (not shown in FIG. 1) which serves as the main power source for the flasher circuit 10. The power supply 11 is connected with the vehicle battery through a manually actuated on/off switch. An output drive stage 14 comprises a set of load drivers each including a FET for switching different components of the load 12 on and off in timed relationship. Each FET is turned on by a switching voltage supplied from a charge pump 16 to the output drive 14. A micro controller 18 generates timing or enabling pulses for controlling the application of switching voltage from the charge pump 16 to the FETs for sequentially turning the FETs on and off for supplying current to the load. The charge pump 16 is controlled in the generation of the switching voltage by timing pulses from the micro controller 18. The supply voltage $V_{cc}$ for the micro controller 18 is monitored by a low voltage monitor 22 which puts the micro controller is a reset state in the event that $V_{cc}$ drops below a safe voltage level. A manually actuated start switch supplies an input starting signal to the micro controller 18 through a signal conditioning stage 24. Also, a door switch signal is supplied as inputs to the micro controller 18 through the signal conditioning stage 24. A current limit stage 26 applies a current limit signal to the micro controller 18 in response to an overcurrent through any one of the FETs.

Figure 3:
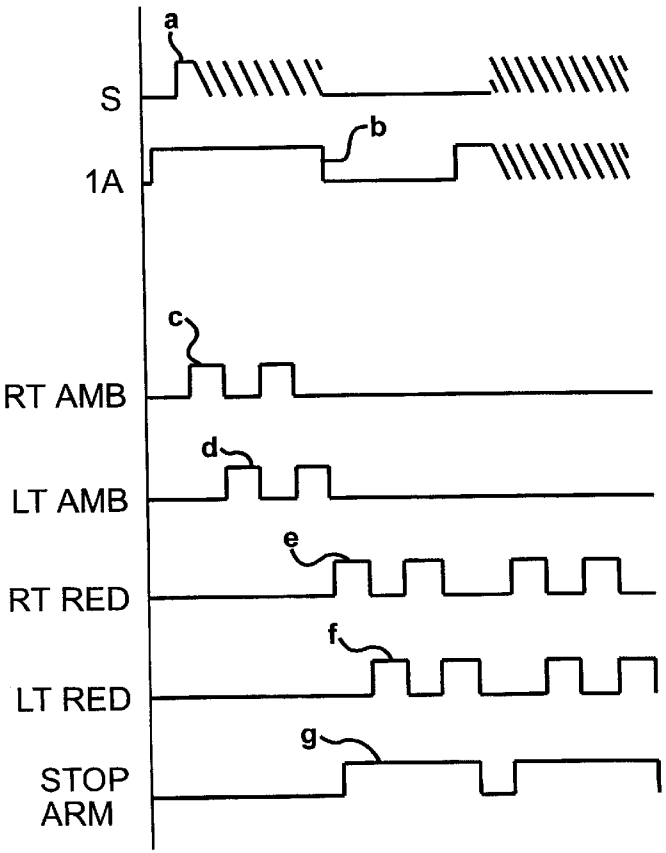
FIG. 3 is a timing diagram representing operation of the warning lamps in a typical installation.
Figure 2:
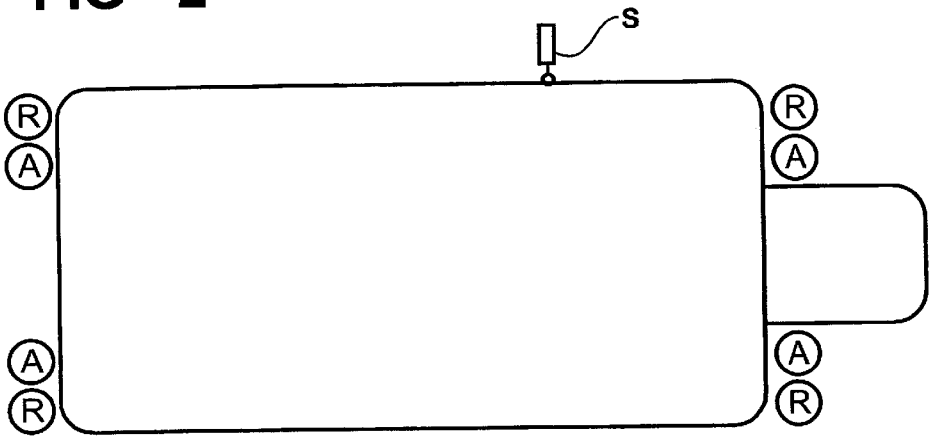
FIG. 2 is a diagrammatic showing of a school bus with warning lamps which are switched by the flasher module of this invention.

A typical school bus flasher and stop arm arrangement is represented in FIGS. 2 and 3. In FIG. 2, a plan view of a school bus 32 is represented in interrupted lines to show the general location of the warning lamps and the pivotable stop sign. A pair of amber lamps, each represented by a letter A in a circle, are located on the front of the bus, one near the left side and one near the right side. Similarly, a pair of red lamps, which is represented by the letter R in a circle, are located on the front of the bus, one near the left side and one near the right side. Similarly, a pair of amber lamps and a pair of red lamps are located in a similar manner on the rear of the bus. A pivotable stop sign S is located on the left side of the bus.

The sequence of operation of the red and amber lamps and the stop sign is represented in the timing diagram of FIG. 3. When the start switch is momentarily actuated by the bus driver, lamp operation is initiated as follows. The momentary actuation of the start switch S, represented by pulse a which is effective to start the amber lights flashing as represented by the right amber pulse train c and left amber pulse train d. The amber lights will continue to flash until the initiation of flashing of the red lights or until the power is disconnected. It is noted that the amber lights flash alternately with an on time of 400 ms and an off-time of 400 ms. The door switch pulse turns off the amber lamps and turns on the red lamps. When the door switch D is actuated, the flashing of the red lamps is commenced as represented by the right red pulse train d and the left red pulse train e. The on-time and off-time of the red lamps, like the amber lamps, is 400 ms. During the flashing of the red lamps, continuous power is supplied to the stop arm as indicated by the waveform g to maintain the stop sign in the extended position. When the door switch is switched off, the flashing of the red lamps is discontinued.

Detailed Description of the Flasher Circuit

The flasher circuit will now be described with reference to the schematic diagrams of FIGS. 4A and 4B. It is noted that FIGS. 4A and 4B, taken together, constitute the complete schematic of the flasher circuit 10. The circuit sections in the schematic diagram which correspond with the circuit sections of the block diagram in FIG. 1 are designated by the same reference characters in FIGS. 4A and 4B.

Power Supply

The power supply 14 converts voltage from the vehicle battery 36 to the supply voltages required by the various stages of the flasher circuit 10. The vehicle battery 36 is typically a 12 volt battery. The power supply 14 has an on/off switch 38 which is suitably the ignition switch of the school bus so that the power supply 14 is energized when the ignition switch is turned on. The supply voltage $V_{cc}$, suitably 5.6 volts, is generated by the power supply for powering the micro controller 18 and the low voltage monitor section 22. For this purpose, the battery voltage is applied through a resistor 42 across a zener diode 44 and filter capacitors 46 and 48 for clamping the battery voltage to produce the supply voltage $V_{cc}$. The supply voltage $V_{dd}$ is generated by the power supply for powering the current limit section 26. This is provided by applying the battery voltage through a resistor 43 across a zener diode 45 and a filter capacitor 47. The supply voltage $V_{dd}$ is allowed to vary with battery voltage up to a clamping voltage of 22 volts set by the zener diodes 45. The battery voltage $V_{bat}$ is applied directly from the battery 36 through the power supply 14 to the charge pump 16 and to the current limit sections 26.

Signal Conditioning Circuit

The signal conditioning section 24 is provided to protect the inputs of the micro controller 18 from transient conditions which may occur in the input control signals. Also, the inputs are level shifted to the appropriate value for the micro controller. One input control signal is provided by the momentary start switch 53 which is manually actuated by the bus driver. When the switch is actuated it applies the battery voltage across a resistor 54 and is clamped by resistor 56 and zener diode 58. A door actuated switch 62 applies battery voltage through a resistor 64 across a zener diode 66 which clamps the voltage to 5 volts.

Micro Controller

The micro controller 18 is a programmable controller suitably of the type manufactured by Motorola, Inc. as Model No. MC68HC705KJ1. The micro controller is supplied with the voltage $V_{cc}$ on pin 6, labelled $V_{dd}$. Pin 7, labelled $V_{ss}$, is connected to ground. The micro controller clock includes an oscillator 72 coupled with micro controller pins 2 and 3, labelled OSC1 and OSC2. The low voltage monitor 22 is operative to monitor the value of the supply voltage $V_{cc}$ and is coupled to pin 1 of the micro controller, the reset pin being labelled RST.* Monitor 22 resets the micro controller in the event that the voltage $V_{cc}$ drops to an unsafe level. Voltage $V_{cc}$ is applied to the micro controller pin 16, the interrupt request pin labelled IRQ.* The remaining inputs and outputs of the micro controller 18 will be described subsequently in relation to the circuit stages with which they are coupled.

Output Drive Stage and Load

As discussed above, the output drive stage 14 is a switching circuit for applying the battery voltage $V_{bat}$ to electrical load devices such as described with reference to the timing diagram of FIG. 3. As shown in FIG. 4B, the electrical load 12 comprises the front right red lamp 76 and the rear right red lamp 76' which are connected between the output terminal 78 of the output drive stage 14 and ground. The load also comprises a front left red lamp 82 and the rear left red lamp 82' connected between the output terminal 84 of the output drive stage 14 and ground. Similarly, the front right amber lamp 86 and the rear right amber lamp 86' are connected between the output terminal 88 of the output drive 14 and ground. Also, the front left amber lamp 92 and the rear left amber lamp 92' are connected between output terminal 94 of the output drive 14 and ground. The electrical load 12 additionally includes the solenoid 96 for actuating the pivotable stop sign. The solenoid is connected between an output terminal 98 of the output drive stage 14 and ground.

The output drive stage 14 comprises, in general, a set of four FETs 102*a*, 102*b*, 102*c* and 102*d* which are suitably N-channel FETs. Each of the FETs has its drain lead connected with the $V_{bat}$ supply voltage through a current sensing resistor 112. Each of the FETs has its source lead connected with the output terminals 78, 84, 88 and 94, respectively. The gate lead of each of FETs is connected, respectively, through resistors 104*a*, 104*b*, 104*c* and 104*d* to the source lead of the FET. For the purpose of energizing the solenoid 96, a pair of steering diodes 114*a* and 114*b* are provided to couple the output terminals 78 and 84 to output terminal 98. The diodes 116 and 118 filter out transient noise. This provides for energization of the solenoid 96 throughout the duration of the time interval when either the right side red lamps or the left side red lamps are turned on.

In order to switch a selected one of the FETs from off to on, a switching voltage must be applied to the gate of the FET which is substantially higher than the voltage $V_{bat}$ applied to the drain of the FET. Accordingly, a switching voltage source, suitably the charge pump 16, is provided which will be described below.

Charge Pump

The charge pump sections 16 will be described with reference to FIG. 4B. The charge pump sections 16 is used to boost the battery voltage $V_{bat}$ to a level sufficient for switching the FETs between off and on states. The charge pump is suitably of conventional design. It is switched between alternate states by a pulse train generated on pin 5 labelled PB2. The charge pump includes a pair of transistors 122 and 124.

Pin 5 of the micro controller is coupled through line 121 to the base of transistor 122 and applies a train of positive pulses thereto, suitably at a fifty percent duty cycle. When the base of transistor 122 goes high, the transistor is turned on and the collector goes low to ground. This causes the capacitor 126 to charge through resistor 128 and diode 132. When the collector of transistor 122 is low, there is no base drive for transistor 124 and it is turned off. When transistor 124 is off, its collector and the negative side of capacitor 134 are pulled up to the battery voltage $V_{bat}$ through resistor 136 causing the positive side of capacitor 134 to discharge thereby adding its charge to capacitor 142. When the micro controller drives the base of transistor 122 low, the collector and negative side of capacitor 126 are pulled up to the battery through resistor 137. This causes capacitor 126 to discharge, forward biasing diode 138, and adding its charge to that of capacitor 134. With the collector of transistor 122 now in a high state, the base of transistor 124 goes high and this drives the collector of transistor 124 low. With the collector low, capacitor 134 charges back up to the battery voltage $V_{bat}$ through resistor 128, diode 132 and diode 138. This completes a charging cycle. The capacitor 142 is a filter capacitor to eliminate any ripple caused by the charging and discharging of capacitors 126 and 134. The zener diode 144 limits the voltage across the capacitor 142 to 22 volts, a safe voltage for the output drive section. The output of the charge pump at the line 146 is supplied to the output drive section 14 for switching the FETs, as will be described below.

FET Switching Circuits

As described above, there are four different components of the load circuit 12, as follows. The first part of the load circuit comprises the red lamps 76 and 76' along with solenoid 96; the second part of the load circuit comprises the red lamps 82 and 82' along with the solenoid 96; the third part of the load comprises the amber lamps 86 and 86'; and the fourth part of the load comprises the amber lamps 92 and 92'. The output drive stage 14 includes four FET switching circuits 148*a,* 148*b,* 148*c* and 148*d* corresponding to the four different load components described above. Each switching circuits include one of the FETs 102*a,* 102*b,* 102*c* and 102*d*. Each switching circuit also includes a FET turn on switch and an enabling or timing switch as follows. Switching circuit 148*a* includes a FET turn on switch or transistor 152*a* and a timing switch or transistor 154*a*. Similarly, the switching circuit 148*b* includes a FET turn on switch 152*b* and a timing switch 154*b*. Likewise, switching circuit 148*c* and switching circuit 148*d* include FET turn-on switches 152*c* and 152*d* and include timing switches 154*c* and 154*d,* respectively.

To turn on a specific lamp load, such as the red lamps 76 and 76' the micro controller 18 generates a logic high pulse on pin 11, labelled PA4, which is connected to the base of the timing transistor 154*a* through the enabling line 156*a*. Accordingly, the collector is pulled to ground. This causes the base of turn-on transistor 152*a* to go low which turns on the transistor. With transistor 152*a* turned on, the FET switching voltage on line 146 is applied to the gate of FET 102*a*. This turns on FET 102*a* for the duration of the logic high at pin 11 of the micro controller, i.e. for 400 milliseconds. With the FET 102*a* turned on, current flows from the battery supply $V_{bat}$ through the current sensing resistor 112 and thence between the drain and source pins of the FET to the load which comprises the parallel connection of red lamps 76, and 76' and the solenoid 96. When the timing pulse on pin 11 of the micro controller ends, the timing pulse on the pin 10 commences and is effective to turn on the FET 102*b* in the same manner as just described for the FET 102*a*.

Each of the FETs 102*a,* 102*b,* 102*c* and 102*d* is protected against overcurrent such as the inrush current, other transients and short circuit current by the current limit section 26 which will be described below.

Current Limit Section

The current limit section will be described with reference to FIGS. 4A, 4B and 5. It will be helpful to consider the operational characteristics of the current limit section 26 before the details of the circuitry are described.

Figure 5:
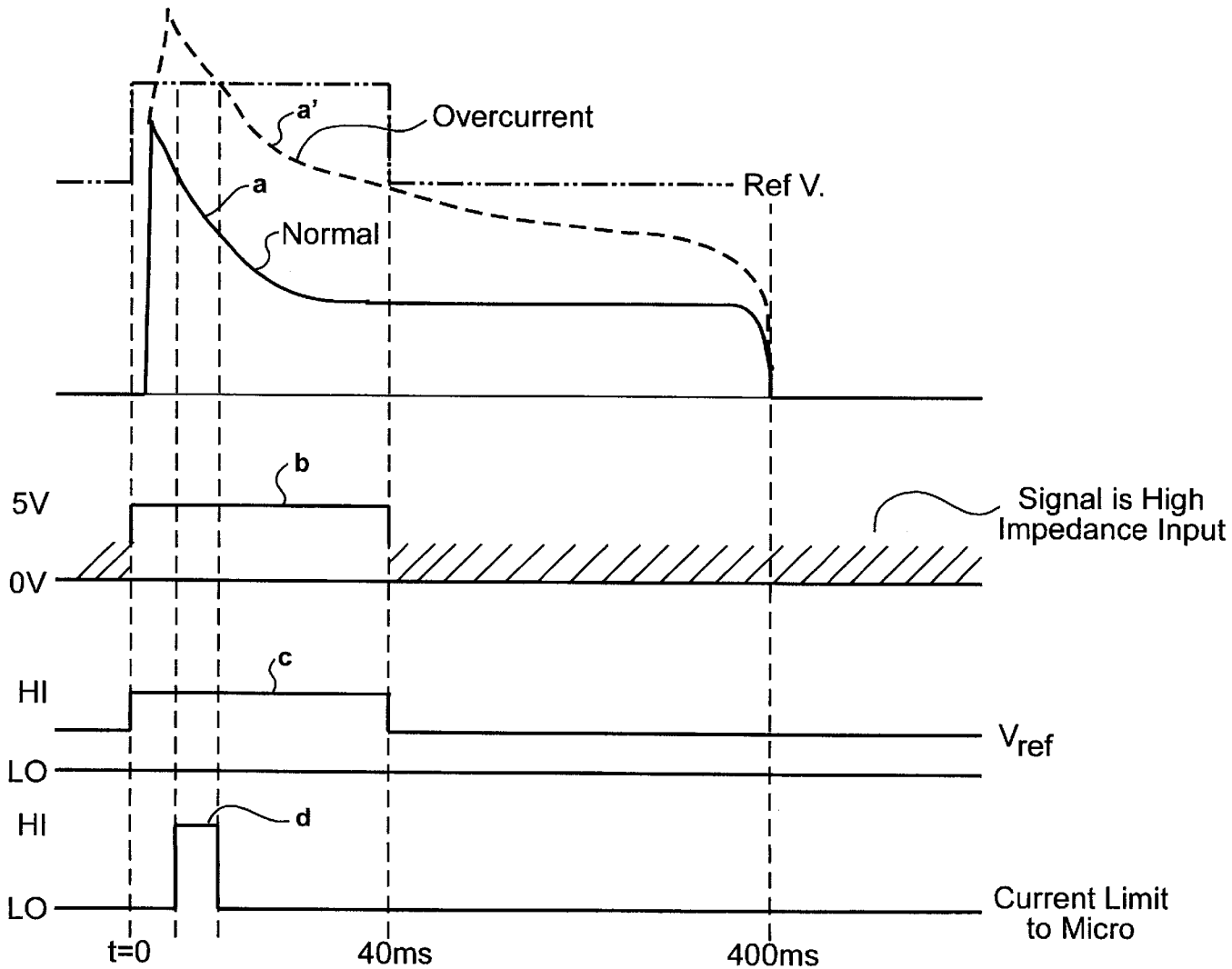
FIG. 5 is a timing diagram representing an operational condition of the switching circuit.

FIG. 5 is a timing diagram which shows the operation of the current limiting function. In this diagram, the waveform a shows a normal or rated load current which is carried by the FET 102*a*. The amplitude as a function of time is of such characteristic that the current waveform a is not an overcurrent for the FET. It is noted that there is an initial inrush current which quickly rises to a peak value and then decreases to a steady state value in a period of about 40 ms. As discussed above, the right side and the left side lamps are alternately turned on for a period of 400 ms. Note that in FIG. 5 the waveform a is interrupted, i.e. foreshortened in the interval between the 40 ms point on the graph and the 400 ms point, for the purpose of simplifying the illustration. The other timing waveforms in FIG. 5 are foreshortened in the same manner. The waveform a' represents lamp current having an excessive or overcurrent value which would be damaging to the FET if it were allowed to continue. The current limit circuit protects the FET against such overcurrent conditions.

Referring further to FIG. 5, waveform b represents the voltage level on pin 4 (PB3) of the micro controller during the first 40 milliseconds of the on-time of the set of lamps controlled by FET 102*a*. Waveform c represents a reference voltage for use in current limit control during the on-time of the set of lamps controlled by FET 102*a*. Waveform d represents a current limit control signal which occurs during an overcurrent condition in FET 102*a* during the inrush current to the lamps.

Figure 4A:
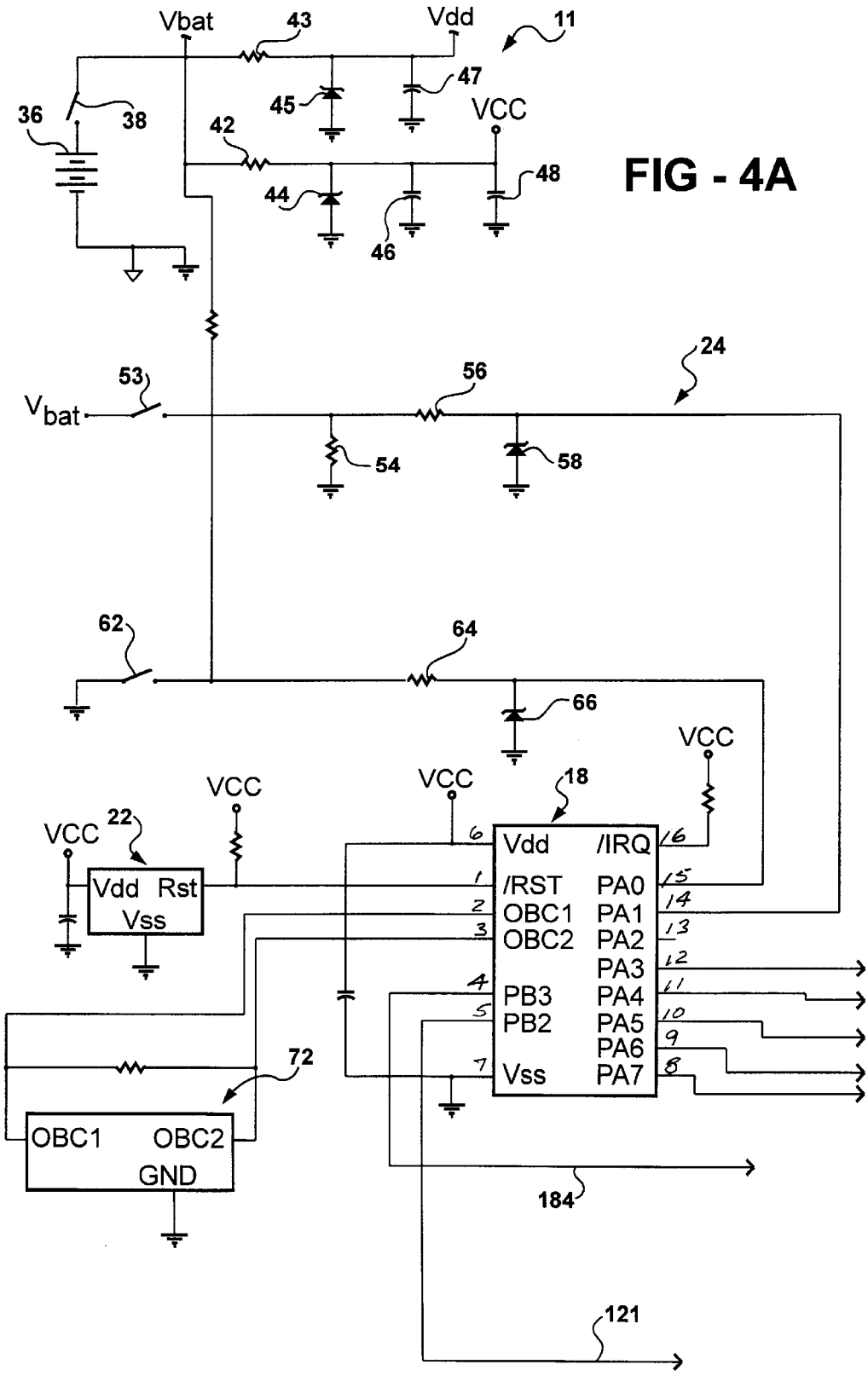
FIGS. 4A and 4B taken together constitute a schematic diagram of the switching circuit of this invention.
Figure 4B:
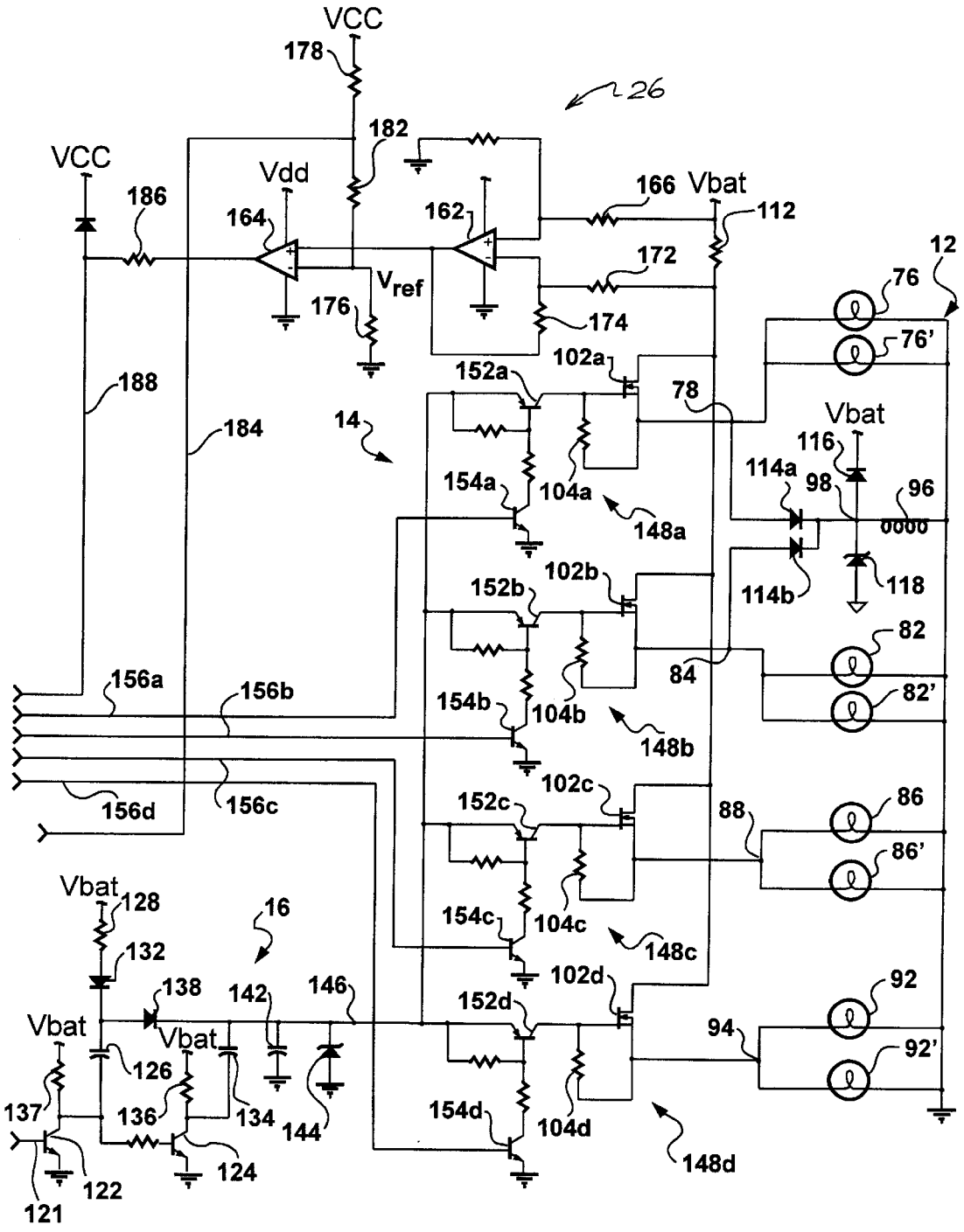

Referring now to FIGS. 4A and 4B, the current limit section 26 will be described in detail. This circuit monitors the load current which is supplied through the FETs in the output drive section 14 to the load 12. It is operative to set a higher limit for the load current during the inrush current period and to set a lower current limit during the steady state load current. If the load current exceeds either limit, the circuitry is operative to turn off the FET for the duration of the fault that caused the overcurrent.

The current limit stage 26 comprises a pair of operational amplifiers (op-amp) 162 and 164 in a configuration that constitutes a comparator. The op-amp 162 measures and amplifies the voltage across the current sensing resistor 112 which represents the value of the load current flowing through the resistor. The supply voltage $V_{bat}$ is monitored at the non-inverting input of the op-amp 162 through resistor 166 which is connected as a voltage divider with resistor 168. The difference in voltage across the current sensing resistor 112 is monitored at the inverting input of the op-amp 162 through resistor 172 which is connected to the inverting input and also connected through resistor 174 with the output of the op-amp. Resistors 168 and resistors 174 are configured in such a way to allow the op-amp 162 to amplify the voltage across the current sensing resistor 112. The amplified output of op-amp 162 is applied to the non-inverting input of op-amp 164. The op-amp 164 compares the voltage on the non-inverting input to a variable reference voltage $V_{ref}$. This reference voltage is generated across a resistor 176 by current from the voltage source $V_{cc}$ through resistors 178 and 182. The value of the current, and hence the reference voltage $V_{ref}$, is controlled by micro controller 18.

In order to set the reference voltage at a higher level for a predetermined time interval of the inrush current, say 40 milliseconds after turn-on of FET 102*a*, a logic high voltage is applied to the junction of resistors 178 and 182 by the logic high output on pin 4 (PB3) through a reference voltage control line 184, as shown in waveform b of FIG. 5. This in effect shorts the resistor 178 to the voltage level $V_{cc}$ and raises the reference voltage $V_{ref}$ at the inverting input of the op-amp 164. In order to set the reference voltage at a lower level for a second predetermined time interval, i.e. the remainder of the 400 millisecond lamp on-time interval (during the state operation) the logic high output on pin 4 (PB3) is removed and the micro controller switches pin 4 simultaneously from an output pin to a high impedance input pin. This is represented in FIG. 5 by hatch lines following waveform b. Thus, the junction of resistors 178 and 182 is connected through the reference voltage control line 184 to a high impedance. This causes the reference voltage across resistor 176 to decrease to a lower level because resistor 178 is effectively reconnected in the voltage divider string of resistors.

Whenever the voltage output of op-amp 162 exceeds the voltage $V_{ref}$, at any time during the 400 ms on-time, the output of the op-amp 164 goes to a logic high. This signal represents an overcurrent condition and is applied through a resistor 186 and a current limit line 188 to pin 12 (PA3). This signals the micro controller that a current limit condition exists and the micro controller switches the enable switch lines 156*a*, 156*b*, 156*c* and 156*d* to logic low thereby resulting in turn-off of the FET 102*a*.

The FET 102*a* is held in the off condition for the remainder of the 400 millisecond period. The micro controller also sets a flag in relation to the FET 102*a* and proceeds to produce a timing signal on pin 10 which is applied through the enable line 156*b* for energizing the left red lamps. After the turn off of the left red lamps, the flag which was set in relation to the FET 102*a* will inhibit the turn on of the FET 102*a* and this will continue until the system is powered down as by turning off the on/off switch. When the system is powered up again, the flag which was set in relation to FET 102*a* is no longer set and if the fault condition which caused the overcurrent still exists, the current limit stage 26 will produce a current limit signal again and the operation will repeat as described above.

The current limit section 26 has been described above with reference to FET 102*a* as the conducting FET being monitored by the current limit section. It will be understood that the current limit section 26 operates in the same manner with respect to the FETs 102*b*, 102*c* and 102*d* when they sequentially become operative in the operating cycle of the flasher circuit.

Floating Ground

Protection For FETs

Figure 6A:
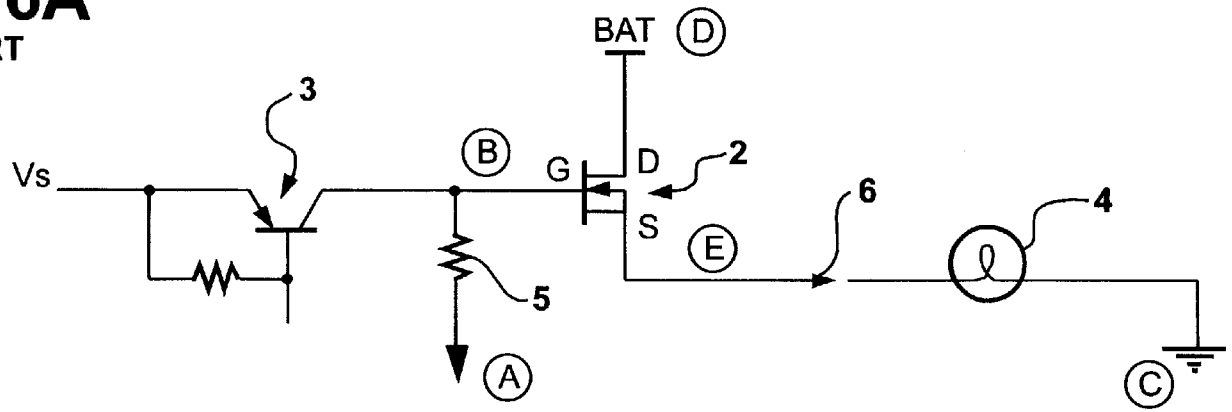
FIG - 6A PRIOR ART
FIG. 6A shows a prior art FET switching circuit in schematic form.

Special precautions need to be taken in the use of FETs in a flasher circuit module to protect against damage of the FETs in a floating ground condition of the flasher circuit. Floating ground is a circuit condition which obtains when the ground pin of the flasher module is not connected to ground at a time when the battery pin of the module is connected to the battery. In a prior art flasher circuit, which is depicted in FIG. 6A, the FET 2 is connected in circuit with a switching transistor 3 for turning the FET on to supply load current from the battery to an electrical load comprising a lamp 4. When the switching transistor 3 is turned on, it applies a switching voltage $V_s$ across the resistor 5 which turns on the FET 2. If a floating ground condition exists in the circuit of FIG. 6A, the FET will be damaged if the battery pin of the module is connected to the battery, for the following reason. Note that ground symbol at point A represents a connection to the chassis ground of the flasher module. Note further that the ground symbol at point C represents battery ground. Point A is not connected to battery ground because the ground pin of the module (not shown in FIG. 6A) is not connected to battery ground. Accordingly, point A floats high to the same potential as point D, i.e. to the battery potential. This raises point B to the battery potential also. Point C is vehicle ground to which the lamp 4 is connected. Accordingly, point E is held at ground through the lamp. In this condition, the gate-to-source voltage across the points B and E is high enough that the FET partially turns on. The power dissipated in the FET is enough to destroy it.

Figure 6B:
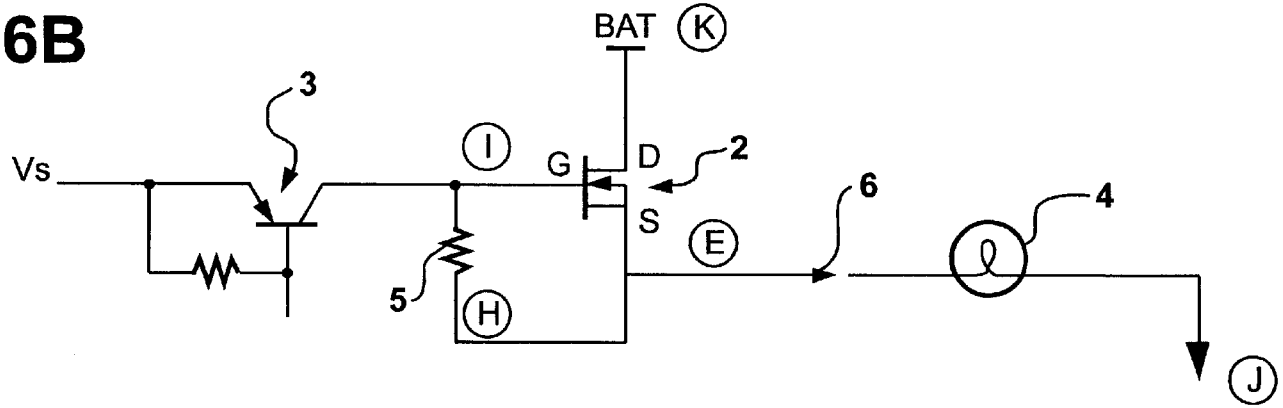
FIG. 6B shows a FET switching according to this invention.

To protect the FET in a flasher module against the floating ground condition, the circuit of FIG. 6B is provided. Note that the difference from circuit 6A is that the lower end of resistor 5 is tied directly to the load terminal 6 instead of being tied to chassis ground in the module. When the floating ground condition exists, point H is connected through the lamp 4 to vehicle ground J. As a result, point I is held low, at vehicle ground potential, thereby preventing the FET from turning on.

Summary of Operation

The operation of the flasher module of this invention is summarized as follows. Flashing of the amber lamps is initiated by manual operation of the start switch 38 by the bus driver as a warning signal that the bus is approaching a stop. The right front amber and right rear amber lamps 86 and 86' are turned on simultaneously by FET 102*c* for a 400 ms interval and then the left front amber and left rear amber lamps 92 and 92' are turned on simultaneously by FET 102*d* for a 400 ms interval. The right and left amber lights are flashed alternately as represented by the pulse trains c and d in FIG. 3. The amber lights continue to flash until the door switch is actuated by the opening of the door at which time the flashing of the red lamps is initiated. The right front red and the right rear red lamps 76 and 76' are turned on simultaneously by FET 102*a* for a 400 ms interval and then the left front red and left red lamps 82 and 82' are turned on simultaneously for the next 400 ms interval. This is represented in FIG. 3 by pulse trains e and f. The pivotable stop sign S is actuated by solenoid 96 to its operative position during the entire period that the red lamps are flashed. The energization of the red lamps and the solenoid 96 is terminated when the door switch is turned off.

The operation of the output drive section 14 including the FETs 102*a*, 102*b*, 102*c* and 102*d* and the associated switching circuits is the same as that described above with reference to FET 102*a*.

Conclusion

Although the description of this invention has been given with reference to a particular embodiment, it is not to be construed in a limiting sense. Many variations and modifications will now occur to those skilled in the art. For a definition of the invention, reference is made to the appended claims.

What is claimed is:

1. A flasher circuit for a school bus of the type adapted for flashing right and left side lamps alternately, said flasher circuit comprising;

first and second voltage supply terminals adapted for connection with a vehicle battery, a first pair of output terminals adapted for connection of one of said lamps therebetween and a second pair of output terminals adapted for connection of the other lamp therebetween, a first FET and a second FET, each of said FETs having a gate, drain and source lead, the source lead of the first FET being connected to one terminal of said first pair of output terminals and the source lead of said second FET being connected to one terminal of said second pair of output terminals, the other terminal of said first pair of output terminals and the other terminal of said second pair of output terminals being connected with said second voltage supply terminal, a source of switching voltage for switching said FETs, control means for applying said switching voltage during alternate time slots to the gate lead of said first and second FETs for turning said FETs on and energizing said first and second lamps during said alternate time slots thereby flashing said lamps alternately, and a manual switching means coupled with said control means for initiating the flashing of said lamps, a current sensing means connected between said first voltage supply terminal and the drain leads of said first and second FETs for generating a first signal voltage corresponding to the actual load current, a load current limiting circuit including a reference voltage source for generating a second signal voltage corresponding to a preset limit value of load current and means for changing the reference voltage between a higher level and a lower level.

and comparator means having inputs coupled with said sensing means and said reference voltage source for comparing said first and second signal voltages, said comparator means having an output coupled to said control means for disconnecting said switching voltage from said gate electrodes in response to the first signal voltage exceeding said second signal voltage.

2. A switching circuit for switching an electrical load, said load being of the type which exhibits an inrush current when switched from off to on, said switching circuit comprising:

first and second output terminals adapted for connection of said load therebetween, a FET having gate, drain and source leads, one of said drain and source leads being connected to said first output terminal, first and second voltage supply terminals adapted for connection of a main voltage source therebetween, said second voltage supply terminal being connected with said second output terminal, a source of voltage for switching said FET to turn on said FET whereby current flows through a series path including said current sensing means, said load and said drain and source leads, control means for applying said switching voltage during alternate time slots to the gate electrodes of said first and second FETs for turning said FETs on and energizing said first and second lamps during said alternate time slots thereby flashing said lamps alternately, a current sensing means coupled between said first voltage supply terminal and the other of said source and drain electrodes for generating a first signal voltage corresponding to the actual load current, a load current limiting circuit including a reference voltage source for generating a second signal voltage corresponding to a preset limit value of load current and means for changing the reference voltage between a higher level and a lower level, comparator means having inputs coupled with said sensing means and said reference voltage source for comparing said first and second signal voltages, said comparator means having an output coupled to said control means for disconnecting said switching voltage from said gate electrodes in response to the first signal voltage exceeding said second signal voltage.

3. A flasher circuit as defined in claim 1 including, a third pair of output terminals adapted for connection of an electrical actuator therebetween for actuating a pivotal stop sign, a first steering diode connected between one of said third pair of terminals and one of said first pair of output terminals, and a second steering diode connected between said one of said third pair of output terminals and one of said second pair of output terminals, whereby said electrical actuator is energized throughout the duration of the time interval when either of said lamps are turned on.

4. A flasher circuit as defined in claim 1 wherein said control means is a micro controller.

5. A flasher circuit as defined in claim 1 wherein said current sensing means is a resistor.

6. A flasher circuit as defined in claim 1 wherein said source of switching voltage is a charge pump.

7. A flasher circuit as defined in claim 1 wherein a first resistor is connected between said gate lead and said source lead of said first FET and a second resistor is connected between said gate lead and said source lead of said second FET, whereby each of said FETs is protected against partial turn-on in a floating ground condition.

8. A switching circuit for an in-rush load current, said switching circuit comprising:

a FET for switching the load current, said FET having a gate, drain and source leads, a voltage supply terminal adapted for connection with a voltage source, an output terminal adapted for connection with a load which takes a high in-rush current, a source of switching voltage for switching said FET between on and off conditions, means for applying said switching voltage to said gate lead for turning on said FET energizing said load, a current sensing means connected between said voltage supply terminal and the drain lead of said FET for generating a first signal voltage corresponding to actual load current, a load current limiting circuit including a reference voltage source for generating a second signal voltage corresponding to a preset limit value of load current and means for changing the reference voltage between a higher level and a lower level, and comparator means having inputs coupled with said sensing means and said reference voltage source for comparing said first and second signal voltages, said comparator means having an output coupled to said control means for disconnecting said switching voltage from said gate electrode in response to the first signal voltage exceeding the second signal voltage.

9. The invention as defined in claim 8 wherein said control means is a micro controller.

10. The invention as defined in claim 8 wherein said current sensing means is a resistor.

11. The invention as defined in claim 8 wherein said source of switching voltage is a charge pump.

12. The invention as defined in claim 8 wherein a resistor is connected between said gate lead and said source lead of said FET whereby the FET is protected against partial turn-on in a floating ground condition.

* * * * *